United States Patent [19]

Morrow, Sr. et al.

[11] 4,136,855

[45] Jan. 30, 1979

[54] HOIST DRUM DRIVE CONTROL

[75] Inventors: James G. Morrow, Sr.; David J. Pech; Charles A. Hunter, II, all of Manitowoc, Wis.

[73] Assignee: The Manitowoc Company Inc., Manitowoc, Wis.

[21] Appl. No.: 747,331

[22] Filed: Dec. 3, 1976

[51] Int. Cl.[2] ..... B66D 1/30

[52] U.S. Cl. ..... 254/150 FH; 60/483

[58] Field of Search ..... 254/150 R, 150 FH, 186 R, 254/168; 60/905, 483, 484, 492, 706; 137/488, 487, 567, 51

[56] References Cited

U.S. PATENT DOCUMENTS

| | | | |
|---|---|---|---|
| 3,698,690 | 10/1972 | Beaver | 254/186 |
| 3,757,524 | 9/1973 | Poynar et al. | 60/483 |
| 3,768,263 | 10/1973 | Olson et al. | 60/905 |
| 3,849,985 | 11/1974 | Ratliff et al. | 60/483 |
| 3,972,186 | 8/1976 | Humphreys | 60/483 |

FOREIGN PATENT DOCUMENTS

| | | | |
|---|---|---|---|
| 2507029 | 9/1975 | Fed. Rep. of Germany | 254/150 FH |
| 1352028 | 5/1974 | United Kingdom | 60/905 |

*Primary Examiner*—Trygve M. Blix
*Assistant Examiner*—Kenneth Noland
*Attorney, Agent, or Firm*—Leydig, Voit, Osann, Mayer & Holt

[57] ABSTRACT

A hoist drum drive control is provided with both variable displacement and fixed displacement motors geared to the drum and connected in parallel to a variable displacement pump. During high speed hoisting the variable displacement motor is shifted to zero displacement until the back pressure reaches a certain level at which time the displacement is automatically increased until a balanced condition is achieved. When lowering heavy loads a feedback to the variable pump decreases its displacement to prevent over speeding the engine.

3 Claims, 1 Drawing Figure

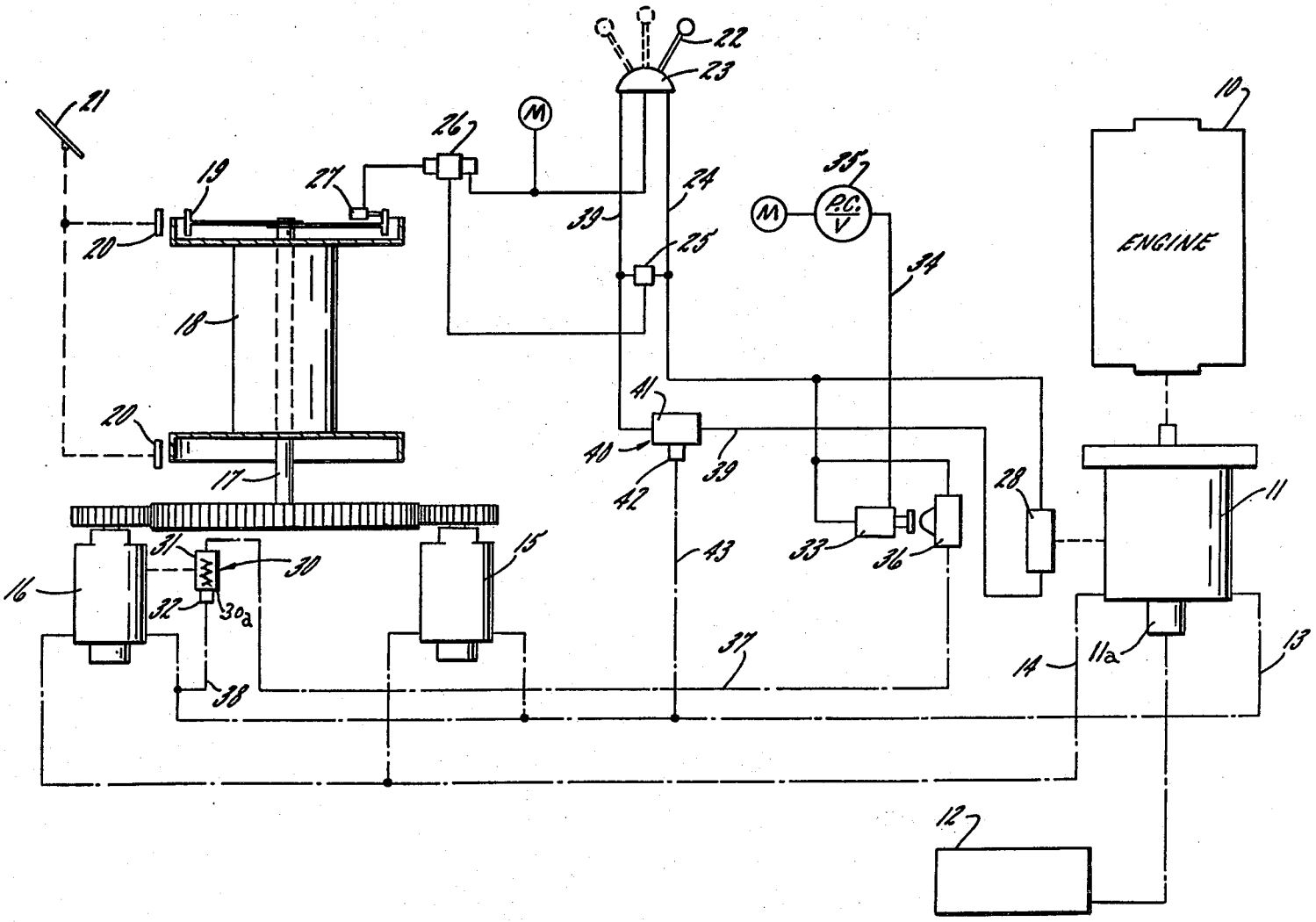
ENGINE
10
11
11a
12
13
14
15
16
17
18
19
20
21
22
23
24
25
26
27
28
29
30
30a
31
32
33
34
35
36
37
38
39
40
41
42
43
M
M
P.C.
V

HOIST DRUM DRIVE CONTROL

The present invention relates generally to hoist drum drive systems and more particularly concerns a hydraulic drum drive control with automatic feedback.

In load lifting devices it is desirable to have a hoist drum drive which permits lifting heavy loads under safe and controlled conditions and which can lift lighter loads at faster speeds. It is also desirable to lower heavy loads without the unnecessary application of the hoist drum brakes, yet without danger of overspeeding the hoist drum drive engine.

According to the present invention there is provided a hydraulic control system for a hoist drum drive employing an engine driven variable displacement pump coupled through hydraulic supply/return lines to a fixed and a variable displacement motor geared to the drum. During high speed hoisting the variable displacement motor is automatically shifted to zero displacement but as the hydraulic pressure increases, due to increasing loads, the variable displacement motor is shifted toward positive displacement thus increasing the torque imparted to the drum and decreasing the speed of the lift. During lowering, the variable motor is at maximum displacement and both motors act as pumps tending to drive the engine driven pump as a motor. When a heavy load is lowered this would cause the engine to speed up or overrun and, if the drum brakes were not applied, this could be dangerous. In the present control circuit, engine overrun is prevented by a feedback circuit which automatically decreases the engine pump displacement when the hydraulic pressure in the return line reaches a certain level. With less displacement, the pump (acting as a motor) exerts less torque on the engine and thus does not cause it to overspeed.

These and other objects and advantages of the invention will become more readily apparent upon reading the following description and upon reference to the drawing which illustrates, in schematic form, the control system for the hoist drum drive of the present invention.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Turning now to the drawings, there is shown a control system for the hoist drum drive of a lifting device such as, for example, a lift crane. In the illustrated embodiment, an engine 10 drives a variable displacement pump 11 having a charging pump section **11*a* which is supplied with hydraulic fluid from a reservoir 12. Connected in parallel to the pump 11 through supply/return lines 13 and 14 are a fixed displacement motor 15 and a variable displacement motor 16 geared to the drive shaft 17 of the hoist drum 18. A clutch 19 interconnects the drive shaft 17 and the drum 18. The drum 18 is also provided with external brake bands 20 which may be manually operated such as by a foot pedal 21**.

An operator's control lever 22 is provided for controlling the hoist drum in both hoisting and lowering directions. The control lever 22 operates a valve 23 supplied with air from a source such as a manifold M. As shown in solid lines in the drawings, the lever 22 is in the hoisting position and the valve 23 admits air under pressure into hoist control line 24. Air from line 24 passes through a shuttle valve 25 to a relay 26 which communicates manifold pressure to a clutch operator 27 thereby engaging the clutch 19 with the drum 18.

To control the output of the engine-driven variable discharge pump, a pneumatic actuator 28 is connected to the line 24. The actuator 28 is normally biased to the zero displacement position and air pressure in line 24 shifts the actuator toward maximum positive displacement during hoisting operation thus delivering hydraulic fluid through supply/return line 13 to the fixed and variable displacement motors 15, 16 geared to the hoist drum 18.

To control the displacement of the variable displacement motor 16, a fluid actuator 30 is provided. It will also be appreciated that when the variable displacement motor is shifted by the actuator 30 to maximum displacement, maximum torque is transmitted to the hoist drum. Conversely, when the variable displacement motor 16 is shifted to zero displacement, all of the hydraulic fluid is routed through the fixed displacement motor 15 and the hoisting speed is increased. The actuator 30 is normally biased by an internal spring **30*a* to the zero displacement position and includes a pneumatic section 31 opposing the bias of the spring in one direction and a hydraulic section 32 of reduced effective area opposing the bias of the spring in opposite direction. When the engine is running, the charge pressure in line 13 generated by pump 11*a* is communicated through a line 38 to the hydraulic section 32 and is sufficient to shift the actuator 30** against the spring bias to the maximum displacement condition.

During low speed hoisting, the lever 22 is pulled back from the center (or neutral position) partially toward the solid line position shown in the drawing and pressurized air is delivered from the valve 23 through line 24 to the pump actuator 28 shifting the pump into the positive displacement hoisting mode. As mentioned above, the fluid actuator 30 is urged to maximum positive displacement by the pressure in the hydraulic section 32 and both the fixed displacement motor 15 and the variable displacement motor operate at full torque and at a speed commensurate with the output from the variable displacement pump depending on how far the pump actuator 28 is shifted under control of the lever 22.

In accordance with the present invention, high speed hoisting is effected by shifting the variable displacement motor 16 to zero displacement. Then all of the pump output is routed to the fixed displacement motor 15 increasing its speed and that of the drum 18 while the variable displacement motor 16 is driven in an idling condition by the drum gearing. When the lever 22 is shifted to the high speed hoisting position (solid line position in the drawing) the air pressure in line 24 exceeds a predetermined value, e.g. 70 psi and actuates a valve operator 33 having a piston (not shown) opposed by air delivered from the manifold through line 34 at a constant pressure as set by a control valve 35. Actuation of the valve operator 33 opens a normally closed valve 36 which permits pressurized air from line 24 to pass through the valve 36 and a line 37 connected to the pneumatic section 31 of the variable motor actuator 30. This pressure in the pneumatic section 31 further biases the spring **30*a* and shifts the actuator 30** to the zero displacement position.

If a heavy load is being hoisted, the pressure in the hydraulic supply line 13 increases and this pressure is communicated through the line 38 from the supply line 13 to the hydraulic section 32 of the actuator 30. As the pressure in section 32 increases it opposes the bias of the spring 30*a*. and, at a predetermined pressure level, e.g. 2800 psi begins to shift the actuator 30 toward maximum displacement condition. As the motor displacement is increased, of course, the line pressure is reduced until an equilibrium condition is established. Since the spring 30*a* is being further compressed, the equilibrium pressure in line 38 may increase from about 2800 psi. to 3200 psi. for example. Preferably, the actuator 30 is of the pressure differential type with an effective area in the pneumatic section 31 on the order of about 40 times the effective area in the hydraulic section 32.

When a load is to be lowered, the valve handle 22 is shifted to the left-hand position shown in the drawing sending pressure from the valve 23 through a line 39 to the opposite end of the pump actuator 28 shifting the pump 11 into its reverse displacement or lowering mode. Since there is no air pressure in line 24, the valve operator 33 is shifted to the left by the regulated pressure in line 34 and valve 36 is in its normally closed position. This means no air pressure is delivered through line 37 to the pneumatic section 31 of the variable motor actuator 30 and the hydraulic section 32 in the actuator 30 shifts the variable motor 16 to full displacement condition.

During lowering, the load imposes a torque on the drum 18 which, in turn, tends to drive the motors 15 and 16 through the drum gearing causing the motors to operate as pumps. This pressurizes line 13 which is now the return line into the pump 11. If a heavy load is being lowered, the pressure in line 13 could tend to drive the pump 11 as a motor and thereby cause the engine 10 to overspeed. Unless the drum brakes 20 were quickly applied, the load would continue to accelerate in an unsafe manner causing the engine to "run away"; possibly damaging the engine as well as anything located beneath the rapidly falling load.

Pursuant to the present invention, engine overspeeding during lowering of heavy loads is prevented by an automatic lowering feedback control 40 interposed in the lowering air control line 39. While the feedback control 40 may take various physical forms, it preferably has a throttling air valve section 41 operated by a hydraulic actuating section 42 connected by a conduit 43 to the hydraulic supply/return line 13.

As the pressure in lines 13 and 43 increases, during lowering of a heavy load, the hydraulic actuator 42 throttles down the air valve section 41 of the feedback control thereby decreasing the air pressure delivered through line 39 to the pump actuator 28. Since the pump actuator is biased toward neutral, the lowering mode displacement of the pump 11 is decreased and less torque is delivered by a pump 11 to the engine 10.

We claim as our invention:

1. A hydraulic control system for a hoist drum drive comprising, in combination, an engine driven variable displacement pump, hydraulic motor means including a variable displacement motor and a fixed displacement motor both geared to the drum, hydraulic supply/-return lines interconnecting said pump and said motor means in parallel, a pneumatic actuator for varying the displacement of the pump, said actuator being normally biased to zero displacement position, pneumatic control means for shifting said pump actuator to positive displacement during hoisting operation, a fluid actuator for varying the displacement of said variable displacement motor, said fluid actuator being normally biased to zero displacement condition and having a pneumatic section opposing said bias in one direction and a hydraulic section of reduced effective area opposing said bias in the opposite direction, means for communicating charge pressure from one of said supply lines to said hydraulic section to shift said actuator against said bias to maximum displacement condition, means for supplying air at a predetermined pressure to said pneumatic section to shift said actuator toward zero displacement condition, and means for communicating pressure from said supply line to said hydraulic section of said fluid actuator to increase the displacement of said motor means as the back pressure therein increases with increasing load on the drum.

2. A control system as defined in claim 1 including a normally closed valve interposed between said supply means and said pneumatic section and means for opening said normally closed valve responsive to said pump actuator being moved in a hoisting direction.

3. A hydraulic control system for a hoist drum drive comprising, in combination, an engine driven variable displacement pump, hydraulic motor means geared to the drum, hydraulic supply/return lines interconnecting said pump and said motor means in parallel, a pneumatic actuator for varying the displacement of the variable displacement pump, said actuator being normally biased to zero displacement position, pneumatic control means for shifting said pump actuator to reverse displacement during lowering operation including a source of pneumatic pressure and a manually operated valve for controlling the pneumatic pressure admitted to said actuator, means including a hydraulically controlled throttling valve interposed between said manually operated valve and said actuator, and means for communicating hydraulic pressure from said motor return line to said throttling valve during lowering to move said pump actuator toward zero displacement as said return pressure increases to prevent said pump from overspeeding said engine as heavy loads are lowered.

* * * * *